US008795937B2

(12) United States Patent
Kim

(10) Patent No.: US 8,795,937 B2
(45) Date of Patent: Aug. 5, 2014

(54) MAGENTA POLYMERIZED TONER

(75) Inventor: Jung-Woo Kim, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 13/554,472

(22) Filed: Jul. 20, 2012

(65) Prior Publication Data

US 2013/0029262 A1 Jan. 31, 2013

(30) Foreign Application Priority Data

Jul. 26, 2011 (KR) ..... 10-2011-0074151

(51) Int. Cl.
*G03G 9/08* (2006.01)

(52) U.S. Cl.
USPC ..... 430/108.21

(58) Field of Classification Search
USPC ..... 430/108.21
See application file for complete search history.

(56) References Cited

U.S. PATENT DOCUMENTS

| | | | | |
|---|---|---|---|---|
| 8,435,708 | B2 * | 5/2013 | Nakamura et al. | 430/108.21 |
| 2005/0208398 | A1 * | 9/2005 | Ohmura et al. | 430/45 |
| 2006/0105263 | A1 * | 5/2006 | Moffat et al. | 430/110.2 |

FOREIGN PATENT DOCUMENTS

| | | | |
|---|---|---|---|
| CN | 1328091 | A | 12/2001 |
| CN | 101774730 | A | 7/2010 |
| JP | 2005215234 | A | 8/2005 |
| JP | 2011-65076 | A | 3/2011 |
| KR | 10-2005-0009177 | A | 1/2005 |
| KR | 10-2011-0015928 | A | 2/2011 |

* cited by examiner

*Primary Examiner* — Mark A Chapman
(74) *Attorney, Agent, or Firm* — Rothwell, Figg, Ernst & Manbeck, P.C.

(57) ABSTRACT

This disclosure relates to magenta polymerized toner comprising magenta pigment selected from quinacridone-based derivatives and magenta pigment selected from diketo-pyrrolopyrrole derivatives, having high transfer efficiency, high image density, and uniform particle distribution.

11 Claims, No Drawings

MAGENTA POLYMERIZED TONER

FIELD OF THE INVENTION

The present invention relates to magenta polymerized toner using quinacridone-based pigment and diketo-pyrrolopyrrole-based pigment in combination.

BACKGROUND OF THE INVENTION

Toner refers to paint that is used for electrophotograph development, electrostatic printer and copier, and the like, and may be transferred and fixed on a transferred article to form desired pattern. Recently, as computer documentation becomes more common, there is rapidly increasing demand of image forming apparatus such as a printer, and thereby, toner consumption is also increasing.

A method for preparing toner includes a pulverization method and a polymerization method. According to the most widely known pulverization method, resin and pigment are introduced together through a melting-mixing process, melt-mixed or extruded, and then, pulverized/classified to prepare toner particles. However, since toner particles prepared by this process have non-uniform shape of wide particle diameter distribution, sharp edge, and the like, they have poor chargeability or flowability.

To overcome the above problem, a method of preparing spherical toner particles by polymerization has been suggested. As the method of preparing toner by polymerization, an emulsion polymerization/coagulation method and a suspension polymerization method are known. However, since the emulsion polymerization is difficult to control particle size distribution and has problem in reproducibility of toner quality, the suspension polymerization method is preferred.

However, magenta toner particles formed by suspension polymerization have wide particle size distribution and require a separation process, and a toner prepared using them has low transfer efficiency. For example, when polymerized toner is prepared using pigment having a structure of naphthol, carmine, rhodamine, azo, and the like, although colors required in the market may be satisfied, volume average particle diameter distribution is wide thus requiring a separation process, and transfer efficiency is low.

To keep pace with the future high speed, small size and light weight of printers and copiers, toner cartridge is also being miniaturized. Thus, for miniaturization of cartridge in high speed printers and copiers capable of printing a lot of copies, miniaturization of a drum part where toner waste is collected is required. Therefore, transfer efficiency that enables waste reduction is very important among toner qualities.

DETAILED DESCRIPTION OF THE INVENTION

Technical Problem

The present invention provides magenta polymerized toner having preferable volume average particle diameter, narrow particle size distribution, high transfer efficiency at printing, and high and uniform image density.

Technical Solution

The present invention provides magenta polymerized toner comprising toner particles comprising 100 parts by weight of binder resin; and 1 to 10 parts by weight of a magenta pigment mixture comprising 10 to 70 wt % of quinacridone-based magenta pigment represented by the following Chemical Formula 1, and 30 to 90 wt % of diketo-pyrrolopyrrole-based magenta pigment represented by the following Chemical Formula 2, dispersed in the binder resin.

In case pigment of a quinacridone structure is applied alone for preparation of toner, although the toner has narrow particle diameter distribution and high density image at printing, image is non-uniform. Meanwhile, it was found out that in case toner is prepared using magenta pigment selected from diketo-pyrrolopyrrole (DPP)-based derivatives, narrow particle diameter distribution may be embodied, and image uniformity is good as a result of print evaluation, but transfer efficiency is lowered. Accordingly, the inventors found out that by combined use of quinacridone-based pigment and DPP-based pigment, magenta toner having narrow particle size distribution, excellent transfer efficiency and uniform image density may be provided, and completed the invention.

The present invention also provides magenta polymerized toner wherein total amount of the quinacridone-based magenta pigment represented by the Chemical Formula 1 and the diketo-pyrrolopyrrole-based magenta pigment represented by the Chemical Formula 2 is 1~10 parts by weight, based on 100 parts by weight of the binder resin.

The present invention also provides magenta polymerized toner comprising, based on 100 parts by weight of binder resin, 0.1 to 30 parts by weight of wax, 0.001 to 10 parts by weight of a cross-linking agent, 0.1 to 20 parts by weight of a charge control agent, 0.001 to 8 parts by weight of a molecular weight regulator, and 0.01 to 5 parts by weight of a reaction initiator.

The present invention also provides magenta polymerized toner comprising toner particles having a volume average particle diameter (dv) of 5~10 μm, and volume average particle diameter (dv)/number average particle diameter (dv) of 1.4 or less.

Hereinafter, magenta polymerized toner and preparation method thereof according to specific embodiments of the invention will be explained in detail.

According to one embodiment of the invention, there is provided magenta polymerized toner comprising toner particles comprising a magenta pigment mixture comprising 10 to 70 wt % of quinacridone-based magenta pigment represented by the following Chemical Formula 1 and 30 to 90 wt % of Diketo-pyrrolopyrrole-based magenta pigment represented by the following Chemical Formula 2.

[Chemical Formula 1]

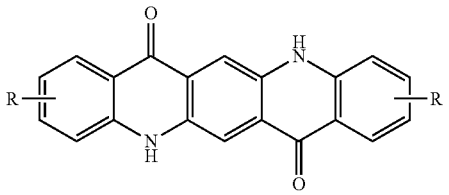

wherein, R is independently —$OCH_3$, $CH_3$, H, F, Cl or $CF_3$.

[Chemical Formula 2]

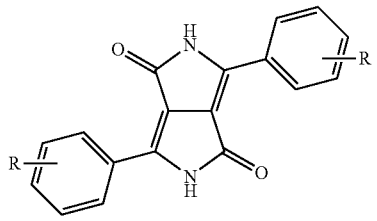

wherein, R is independently -t-butyl, $CH_3$, H, phenyl, Cl or CN.

As the quinacridone-based derivative magenta pigment represented by the Chemical Formula 1, compounds represented by the following Chemical Formula 3 and Chemical Formula 4 may be preferably used.

[Chemical Formula 3]

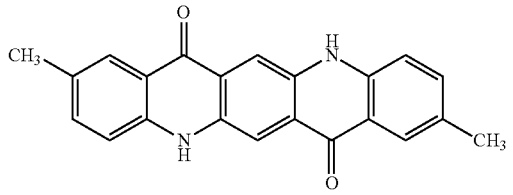

[Chemical Formula 4]

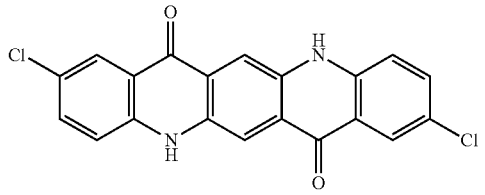

As the diketo-pyrrolopyrrole-based magenta pigment represented by the Chemical Formula 2, compounds represented by the following Chemical Formula 5 and Chemical Formula 6 may be preferably used.

[Chemical Formula 5]

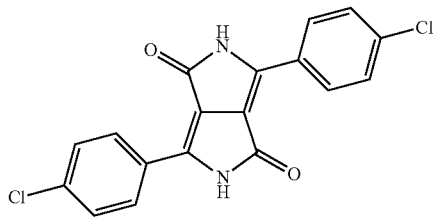

-continued

[Chemical Formula 6]

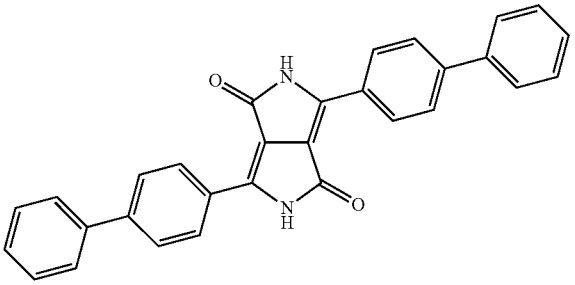

According to the above embodiment, the polymerized toner may comprise toner particles comprising binder resin; and a mixture of magenta pigment selected from quinacridone-based compound and magenta pigment selected from diketo-pyrrolopyrrole-based compound, dispersed in the binder resin.

Total amount of the mixture of the quinacridone-based magenta pigment and the diketo-pyrrolopyrrole-based magenta pigment is preferably 1~10 parts by weight, based on 100 parts by weight of binder resin included in the polymerized toner. And, total amount of the mixture of the quinacridone-based magenta pigment and the diketo-pyrrolopyrrole-based magenta pigment may be 2 to 9 parts by weight, or 3 to 9 parts by weight, based on 100 parts by weight of binder resin included in the polymerized toner.

If the amount is less than 1 part by weight, image density may be low, and if it is greater than 10 parts by weight, polymerization stability may be lowered.

And, in the mixture of the magenta pigment selected from the quinacridone-based compound and the magenta pigment selected from diketo-pyrrolopyrrole-based compound, the quinacridone-based magenta pigment may be included in the content of 10 to 70 wt %, and the diketo-pyrrolopyrrole-based magenta pigment may be included in the content of 30 to 90 wt %. And, the quinacridone-based magenta pigment may be preferably included in the content of 15 to 65 wt %, more preferably in the content of 20 to 60 wt %, and the diketo-pyrrolopyrrole-based magenta pigment may be preferably included in the content of 35 to 80 wt %, more preferably in the content of 40 to 75 wt %.

If the content of the quinacridone-based pigment is greater than 70 wt %, based on total weight of the magenta pigment, polymerization stability may be lowered, and image may be non-uniform. And, if the content of the diketo-pyrrolopyrrole-based pigment is greater than 90 wt %, based on total weight of the magenta pigment, image density may become too low, and transfer efficiency may be lowered, and if it is less than 30 wt %, image may become non-uniform.

Meanwhile, the binder resin may include copolymer of styrene-based monomer, acrylate-based monomer, methacrylate-based monomer, diene-based monomer, acidic olefinic monomer, basic olefinic monomer or a mixture thereof, but is not limited thereto, and monomers known to be usable for preparation of toner by suspension polymerization may be used without specific limitations. From these monomers, polymer or copolymer that is used for binder resin of polymerized toner may be formed.

Specifically, the binder resin may copolymer of (a) styrene-based monomer; and (b) at least one monomer selected from the group consisting of acrylate-based monomer, methacrylate-based monomer and diene-based monomer. The copolymer may include 30 to 95 wt % of the (a) monomers, and 5 to 70 wt % of the (b) monomers, based on total weight of the copolymer.

And, the binder resin may be copolymer of (a) styrene-based monomer, (b) at least one monomer selected from the group consisting of acrylate-based monomer, methacrylate-based monomer and diene-based monomer, and (c) at least one monomer selected from the group consisting of acidic olefinic monomer or basic olefinic monomer. The (c) monomers may be copolymerized in the amount of 0.1 to 30 parts by weight, based on total weight of the (a) monomers and the (b) monomers.

The styrene-based monomer may include styrene, monochlorostyrene, methylstyrene, dimethylstyrene, and the like.

The acrylate-based monomer may include methylacrylate, ethylacrylate, n-butylacrylate, isobutylacrylate, dodecyl acrylate, 2-ethylhexylacrylate, and the like. And, the methacrylate-based monomer may include methylmethacrylate, ethylmethacrylate, n-butylmethacrylate, dodecyl methacrylate, 2-ethylhexyl methacrylate, and the like. And, the diene-based monomer may include butadiene, isoprene, and the like.

The acidic olefinic monomer may include α,β-ethylene compounds having a carboxyl group, and the like, and the basic olefinic monomer may include methacrylic acid esters of aliphatic alcohol having an amine group or a quaternary ammonium group, methacryl amides, vinyl amines, diallyl amines, or ammonium salt thereof, and the like.

According to another embodiment of the invention, the toner particles may further include at least one selected from the group consisting of a charge control agent, wax, a cross-linking agent, a molecular weight regulator, and a reaction initiator.

According to the above embodiment, the polymerized toner particles may include, based on 100 parts by weight of binder resin, 0.1 to 30 parts by weight of wax; 0.001 to 10 parts by weight of a cross-linking agent; 0.1 to 20 parts by weight of a charge control agent; 0.001 to 8 parts by weight of a molecular weight regulator; and 0.01 to 5 parts by weight of a reaction initiator.

The charge control agent may include a cationic charge control agent, an anionic charge control agent, or a mixture thereof. The cationic charge control agent may include nigrosine type dye, metal salt of higher aliphatics, alkoxy amine, chelate, quaternary ammonium salt, alkylamide, fluorine-treated activator, metal salt of naphthalenic acid, and a mixture thereof. And, the anionic charge control agent may include chlorinated paraffin, chlorinated polyester, acid-containing polyester, sulfonylamine of phthalocyanine, and a mixture thereof.

As the charge control agent, copolymer having a sulfonic acid group may be preferably used. More preferably, copolymer having a sulfonic acid group, having a molecular weight of 2,000 to 200,000 may be used. Still more preferably, copolymer having a sulfonic acid group, having an acid value of 1-40 mg KOH/g, and glass transition temperature of 30 to 120° C. may be used. If the acid value is less than 1, the copolymer may not function as a charge control agent, and if the acid value is greater than 40, interface property of the monomer mixture may be influenced to worsen polymerization stability. And, if the glass transition temperature is less than 30° C., toner to toner friction-melting may be generated at printing due to low glass transition temperature of the charge control agent exposed to the surface, thus inducing blocking, and if it is greater than 120° C., the surface of toner may be excessively hardened, and thus, properties such as coatability and fixing may not be good. And, if the weight average molecular weight is less than 2,000, surface density may be lowered due to high compatibility with binder resin, and thus, the copolymer may not function as a charge control agent, and it if is greater than 200,000, polymerization stability and particle size distribution may not be good because of increased viscosity of the monomer mixture due to high molecular weight. Specific examples of the copolymer having a sulfonic acid group may include styrene-acrylic copolymer having a sulfonic acid group, styrene-methcaylic copolymer having a sulfonic acid group, and a mixture thereof, but is not limited thereto.

The wax may include paraffin wax, microcrystalline wax, ceresine wax, carnauba wax, ester-based wax, polyethylene-based wax, polypropylene-based wax and a mixture thereof.

The reaction initiator may include an oil-soluble initiators and a water-soluble initiator. Specifically, it may include azo-based initiators such as azobisisobutyronitrile, azobisvaleronitrile, and the like; organic peroxide-based initiators such as benzoylperoxide, lauroylperoxide, and the like; commonly used water-soluble initiators such as potassium persulfate, ammonium persulfate, and the like, and one or two or more kinds thereof may be used in combination.

The cross-linking agent may include divinylbenzene, ethylene, dimethacrylate, ethyleneglycol dimethacrylate, diethyleneglycol diacrylate, 1,6-hexamethylene diacrylate, allyl methacrylate, 1,1,1-trimethylolpropane triacrylate, triallylamine, tetraallyloxyethane, and a mixture thereof.

The molecular weight regulator may include t-dodecyl mercaptan, n-dodecyl mercaptan, n-octyl mercaptan, carbon tetrachloride, carbon tetrabromide, and a mixture thereof.

According to the above embodiment, the toner particles may further include a lubricant or a coupling agent, and those known to be usable for preparation of polymerized toner may be used without specific limitations.

Meanwhile, the toner particles may further include external additives such as silica, titanium dioxide, a mixture thereof, and the like. The external additives may exist in the form of coating on the outermost of the toner particles. The silica may preferably include those surface-treated with silane compounds such as dimethyldichlorosilane, dimethylpolysiloxane, hexamethyldisilazane, aminosilane, alkylsilane, octamethylcyclotetrasiloxane, and the like. As the titanium dioxide, those having a rutile structure at high temperature or a stable anatase structure at low temperature may be used alone or in combination, and those having particle size of 80 to 200 nm, preferably 100 to 150 nm may be used.

According to another embodiment of the invention, there is provided a method for preparing polymerized toner comprising the steps of forming an aqueous dispersion including a dispersant; forming a monomer mixture including monomers for binder resin, quinacridone-based magenta pigment and DPP-based magenta pigment, a charge control agent and wax, and the like; and adding the monomer mixture to the aqueous dispersion and conducting suspension polymerization to form toner particles.

In the step of forming the aqueous dispersion, surfactant known as a dispersion stabilizer or organic•inorganic dispersant may be used. Among them, the inorganic dispersant is preferable because super fine particles are hardly generated, dispersion stability is provided due to the steric hindrance, and thus, stability may not be easily lowered even if reaction temperature is changed. Specific examples of the inorganic dispersant may include phosphate multivalent metal salt such as potassium phosphate, magnesium phosphate, aluminum phosphate, zinc phosphate, and the like; carbonate such as calcium carbonate, magnesium carbonate, and the like; inorganic salt such as calcium meta silicate, calcium sulfate, barium sulfate, and the like; inorganic hydroxide such as calcium hydroxide, magnesium hydroxide, aluminum hydroxide, and the like; inorganic oxide such as silica, bentonite, alumina, and the like. The inorganic dispersant may be used in an amount of 1~10 parts by weight, based on 100 parts by weight of binder resin monomers. In case the inorganic dispersant is used, it may be used as it is, but in order to obtain finer particles, the inorganic dispersant particles may be generated in an aqueous medium. For example, in the case of calcium phosphate, an aqueous solution of sodium phosphate and an aqueous solution of calcium chloride may be mixed under high speed agitation to produce water-insoluble calcium phosphate, which enables more uniform and fine dispersion. At this time, although water-soluble sodium chloride salt is co-produced, if water-soluble salt exist in the aqueous medium, dissolution of monomers in water may be inhibited and generation of super fine toner particles by emulsion polymerization may become difficult. The inorganic dispersant may be completely removed after completion of polymerization by dissolving it in acid or alkali, and subjecting to subsequent processes such as filtration, washing, and the like.

Next, in the step of forming the monomer mixture, the ingredients added to the monomer mixture, including binder resin monomers, magenta pigment, and a charge control agent, and the like are as explained above. To form the monomer mixture, monomers for binder resin, a cross-linking agent, a molecular weight regulator, a charge control agent are mixed and dissolved. And then, quinacridone-based pigment DPP-based pigment are added, the mixture is agitated in a bead mill at 1000 to 2000 rpm, and then, the bead is removed. After removing the bead, wax is added to the mixture to dissolve it, a reaction initiator is added, and the mixture is agitated for 1 to 10 minutes to prepare the monomer mixture.

Next, in the step of forming the toner particles, the monomer mixture is added to the aqueous dispersion, and suspension-polymerized to prepare polymerized toner particles. After the monomer mixture is added to the aqueous dispersion, shearing force is applied with homogenizer at 10000 to 20000 rpm to homogenize the mixture. The homogenized mixture is preferably reacted at 50 to 80° C. for 3 to 24 hours, at 50 to 400 rpm with a paddle-type agitator. And then, the reaction temperature is raised to 85 to 99° C., and the mixture is reacted for 1 to 20 hours.

According to the above embodiment, there is provided toner particles having volume average particle diameter (dv) of 5~10 μm, and volume average particle diameter (dv)/number average particle diameter (dv) of 1.4 or less.

According to the present invention, magenta toner having high transfer efficiency and enabling printing of high resolution image may be provided by combined use of magenta pigment selected from quinacridone-based derivatives and pigment selected from diketo-pyrrolopyrrole-based derivatives.

EXAMPLES

The present invention will be explained in detail with reference to the following Examples. However, these examples are only to illustrate the invention, and the scope of the invention is not limited thereto.

Example 1

686 g of a 0.1M sodium phosphate aqueous solution and 100 g of 1M calcium chloride were mixed in 500 g of water to prepare aqueous dispersion wherein calcium phosphate crystals are precipitated, and then, temperature was raised to a reaction temperature of 70° C., and the mixture was agitated for 20 minutes. The content of calcium phosphate in the aqueous dispersion was 3 parts by weight, based on 100 parts by weight of the monomer mixture.

Binder resin monomers of 160 g of styrene, 36 g of n-butyl acrylate and 4 g of acrylic acid; a cross-linking agent of 4 g of allylmethacrylate; a molecular weight regulator of 0.4 g of n-dodecyl mercaptan; and a charge control agent of 4 g of styrene/2-ethylhexylacrylate/anionic functional monomer copolymer (Mw. 16,500, Fujikura Kasei) were mixed and sufficiently dissolved, 2 g of quinacridone-based magenta pigment (PR202, the compound of the Chemical Formula 4) and 8 g of DPP-based magenta pigment (PR254, the compound of the Chemical Formula 5) were added thereto, and the mixture was agitated in a bead mill of 2,000 rpm for 1 hour, and then, the bead was removed.

After removing the bead, 20 g of paraffin wax (Fisher) was additionally added to the mixture, and the mixture was agitated to completely dissolve the wax in the mixture. And then, 5 g of azonitrile-based initiator (V65, Waco Chemical) was added, and the mixture was additionally agitated for 5 minutes to prepare a monomer mixture. The weight of the monomer mixture was 246.4 g.

And, the monomer mixture was added to the aqueous dispersion, shearing force was applied to the aqueous dispersion and the monomer mixture at 13,000 rpm with homogenizer to disperse the monomer mixture in the aqueous dispersion in the form of fine droplets to homogenize it.

The homogenized mixture was reacted at 60° C. for 10 hours while agitating at 200 rpm with a paddle-type agitator, the temperature was raised to 90° C., and the mixture was additionally reacted for 3 hours to prepare polymerized toner.

Washing and Drying of Toner Particles

Hydrochloric acid was added to the aqueous dispersion including polymerized toner to adjust pH less than 2, and calcium phosphate was dissolved therein. And, water was removed using a filter, distilled water was added in an amount of 2 times of total weight to dilute the mixture, shearing force was applied with homogenizer to homogenize it, and then, the mixture was centrifuged at 3,000 rpm for 15 minutes using centrifuge (Beckman J2-21M, Rotor JA-14). The dilution, homogenization and centrifugation were repeated three times to remove potassium phosphate on the surface of toner. Finally, moisture was removed through filtration, and then, a toner cake was put in a vacuum oven and vacuum-dried at room temperature for 48 hours to prepare a polymerized toner core. The prepared polymerized toner core has volume average particle diameter of 7 μm and the ratio of volume average particle diameter and number average particle diameter (standard deviation) of 1.26. The volume average particle diameter of the core was measured using Coulter counter (multisizer 3, Beckman coulter).

Coating of External Additives 2 parts by weight of silica was added to 100 parts by weight of the polymerized toner core using a Henschel mixer, and then, the mixture was agitated at high speed of 5,000 rpm for 7 minutes to coat external additives on the surface of the polymerized toner core.

Experimental Example

Toner volume average particle diameter and particle size distribution: The size of the prepared toner particles was observed using multisizer Coulter counter.

Toner consumption and transfer rate: A supply par of printer cartridge of HP4600 printer (Hewlett-Packard) was filled with the surface-treated toner, and the total weight of the supply part was measured. And then, a rectangle of 19 cm×1.5 cm was printed 1,000 copies with A4 paper, and the weight of the supply part was measured again to calculate toner consumption amount.

Consumption amount (g)=the weight of the supply part before printing 1,000 copies−the weight of the supply part after printing 1,000 copies The weight of a drum part that may be separated from the supply part was measured before and after printing to calculate the amount of toner that is not transferred on the paper and wasted.

Wasted toner amount (g)=the weight of the drum part after printing 1,000 copies−the weight of the drum part before printing 1,000 copies From the consumed amount and wasted toner amount, transfer efficiency was calculated by the following Equation.

Transfer efficiency(%)={(consumption amount−amount of wasted toner)/consumption amount}*100

Image uniformity: The uniformity of printed solid image was evaluated as 5 grades (A, AB, B, BC, C).

A: very good image uniformity (OEM level)

AB: good image uniformity (slightly below OEM level)

B: satisfactory image uniformity (uniformity is slightly low with precise inspection, but satisfactory level)

BC: poor image uniformity (uniformity seems to be poor with visual inspection, but usable level)

C: bad image uniformity (image is rough and uniformity is very poor. Not usable level)

Polymerization stability: The slurry of the polymerized toner was filtered with 150 um sieve, coagulum remaining in the sieve was dried, and the weight was measured to calculate percentage (%) to total weight of the monomer mixture.

Image density: Printed solid image was measured at the angle of 85° with Gloss meter (BYK company, Micro-TRI-Gloss).

Example 2

Polymerized toner was prepared by the same method as Example 1, except that 4 g of quinacridone-based pigment (PR202, the compound of the Chemical Formula 4) and 6 g of DPP-based pigment (PR264, the compound of the Chemical Formula 6) were used in combination.

Example 3

Polymerized toner was prepared by the same method as Example 1, except that 2 g of quinacridone-based pigment (PR122, the compound of the Chemical Formula 3) and 8 g of DPP-base pigment (PR254, the compound of the Chemical Formula 5) were used in combination.

Example 4

Polymerized toner was prepared by the same method as Example 1, except that 3 g of quinacridone-based pigment (PR122, the compound of the Chemical Formula 3) and 7 g of DPP-based pigment (PR264, the compound of the Chemical Formula 6) were used in combination.

Example 5

Polymerized toner was prepared by the same method as Example 1, except that 6.5 g of quinacridone-based pigment (PR122, the compound of the Chemical Formula 3) and 3.5 g of DPP-based pigment (PR264, the compound of the Chemical Formula 6) were used in combination.

Comparative Example 1

Polymerized toner was prepared by the same method as Example 1, except that 10 g of quinacridone-based pigment (PR202, the compound of the Chemical Formula 4) was used.

Comparative Example 2

Polymerized toner was prepared by the same method as Example 1, except that 10 g of quinacridone-based pigment (PR122, the compound of the Chemical Formula 3) was used.

Comparative Example 3

Polymerized toner was prepared by the same method as Example 1, except that 10 g of DPP-based pigment (PR254, the compound of the Chemical Formula 5) was used.

Comparative Example 4

Polymerized toner was prepared by the same method as Example 1, except that 10 g of DPP-based pigment (PR264, the compound of the Chemical Formula 6) was used.

Comparative Example 5

Polymerized toner was prepared by the same method as Example 1, except that 0.5 g of quinacridone-based pigment (PR122, the compound of the Chemical Formula 3) and 9.5 g of DPP-based pigment (PR254, the compound of the Chemical Formula 5) were used in combination.

Comparative Example 6

Polymerized toner was prepared by the same method as Example 1, except that 9 g of quinacridone-based pigment (PR122, the compound of the Chemical Formula 3) and 1 g of DPP-based pigment (PR254, the compound of the Chemical Formula 5) were used in combination.

Comparative Example 7

Polymerized toner was prepared by the same method as Example 1, except that 10 g of quinacridone-based pigment (PR122, the compound of the Chemical Formula 3) and 20 g of DPP-based pigment (PR254, the compound of the Chemical Formula 5) were used in combination.

Comparative Example 8

Polymerized toner was prepared by the same method as Example 1, except that 0.8 g of quinacridone-based pigment (PR122, the compound of the Chemical Formula 3) and 1.0 g of DPP-based pigment (PR254, the compound of the Chemical Formula 5) were used in combination.

Experiment results of the Examples 1 to 5 and Comparative Examples 1 to 8 are as follows.

TABLE 1

| | Volume average particle diameter (dv) | Volume average particle diameter/number average particle diameter (dv/dp, particle size distribution) | Toner consumption amount (g) | Image uniformity | Toner transfer efficiency (%) | Coagulum (%) | Image density (ID) |
|---|---|---|---|---|---|---|---|
| Example 1 | 7.0 | 1.26 | 20 | AB | 91 | <0.1 | 1.33 |
| Example 2 | 7.1 | 1.25 | 22 | A | 89 | <0.1 | 1.36 |
| Example 3 | 7.5 | 1.23 | 20 | AB | 89 | <0.1 | 1.35 |
| Example 4 | 7.6 | 1.24 | 21.3 | A | 90 | <0.1 | 1.40 |
| Example 5 | 7.7 | 1.24 | 22.0 | AB | 88 | 0.3 | 1.42 |
| Comparative Example 1 | 8.0 | 1.23 | 22.6 | BC | 90 | 7 | 1.40 |
| Comparative Example 2 | 8.2 | 1.24 | 22.3 | B | 92 | 5 | 1.38 |
| Comparative Example 3 | 6.4 | 1.26 | 17.5 | AB | 76 | <0.1 | 1.23 |
| Comparative Example 4 | 6.6 | 1.26 | 18.4 | A | 83 | <0.1 | 1.25 |
| Comparative Example 5 | 6.8 | 1.26 | 18.0 | AB | 80 | 4 | 1.22 |
| Comparative Example 6 | 7.9 | 1.24 | 21 | BC | 91 | <0.1 | 1.39 |
| Comparative Example 7 | — | — | — | — | — | 25 | — |
| Comparative Example 8 | 5.7 | 1.27 | 20.4 | — | — | <0.1 | 0.64 |

As shown in the Table 1, Comparative Examples 1 and 2 using quinacridone-based pigment exhibit satisfactory toner transfer efficiency, image density and volume average particle diameter, but exhibit poor image uniformity. Meanwhile, Comparative Examples 3 and 4 using DPP-based pigment exhibit satisfactory particle diameter distribution and image uniformity, but exhibit lowered transfer efficiency and image density.

And, it was confirmed that in Comparative Example 5 including DPP-based pigment in the content greater than 90% of total pigment, image density and transfer efficiency are lowered, and in Comparative Example 6 including quinacridone-based pigment in the content greater than 70% of total pigment, the amount of coagulum increases to lower polymerization stability and image uniformity. Furthermore, in Comparative Example 7 including pigment in the content exceeding 10 parts by weight, based on 100 parts by weight of binder resin, a large quantity of coagulum is generated and thus print test could not be progressed. And, in Comparative Example 8 including pigment in the content less than 1 part by weight, image density (ID) is lowered.

To the contrary, it was confirmed that Examples 1 to 5 using quinacridone-based pigment and DPP-based pigment in combination exhibit transfer efficiency and particle diameter distribution similar to toner using quinacridone-based pigment, and image uniformity similar to toner using DPP-based pigment. And, image density is also good.

As explained, it was confirmed that magenta polymerized toner having high transfer efficiency and image density and uniform image may be prepared by combined use of quinacridone-based pigment and DPP-based pigment.

The invention claimed is:

1. Magenta polymerized toner comprising toner particles comprising:

100 parts by weight of binder resin; and 1 to 10 parts by weight of a magenta pigment mixture comprising 10 to 70 wt % of quinacridone-based magenta pigment represented by the following Chemical Formula 1, and 30 to 90 wt % of diketo-pyrrolopyrrole-based magenta pigment represented by the following Chemical Formula 2, dispersed in the binder resin:

[Chemical Formula 1]

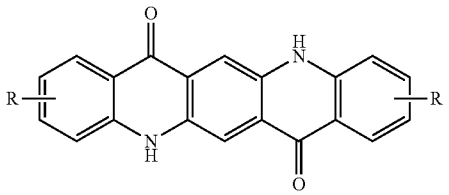

wherein, R is independently —$OCH_3$, $CH_3$, H, F, Cl or $CF_3$

[Chemical Formula 2]

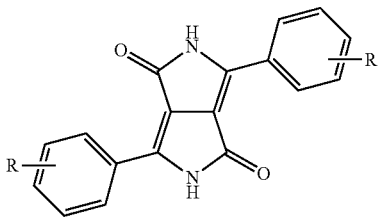

wherein, R is independently -t-butyl, $CH_3$, H, phenyl, Cl, or CN.

2. The magenta polymerized toner according to claim 1, wherein the toner particles further comprises at least one selected from the group consisting of a charge control agent, wax, a cross-linking agent, a molecular weight regulator, and a reaction initiator.

3. The magenta polymerized toner according to claim 2, the charge control agent is nigrosine type acidic pigment, metal salt of higher aliphatics, alkoxy amine, chelate, quaternary ammonium salt, alkyl amide, fluorine-treated activator, metal salt of naphthalenic acid, acidic organic complex, chlorinated paraffin, chlorinated polyester, acid-containing polyester, sulfonylamine of copper phthalocyanine, sulfonic acid group-containing styrene-acrylic polymer, or a mixture thereof.

4. The magenta polymerized toner according to claim 2, wherein the wax is selected from the group consisting of paraffin wax, microcrystalline wax, ceresine wax, carnauba wax, ester-based wax, polyethylene-based wax, polypropylene-based wax, and a mixture thereof.

5. The magenta polymerized toner according to claim 2, wherein the cross-linking agent is selected from the group consisting of divinylbenzene, ethylene dimethacrylate, ethyleneglycol dimethacrylate, diethylenegylcol diacrylate, 1,6-hexamethylene diacrylate, allyl methacrylate, 1,1,1-trimethylolpropane triacrylate, triallylamine, tetraallyloxyethane, and a mixture thereof.

6. The magenta polymerized toner according to claim 2, wherein the molecular weight regulator is selected from the group consisting of t-dodecyl mercaptan, n-dodecyl mercaptan, n-octylmercaptan, carbon tetrachloride, carbon tetrabromide, and a mixture thereof.

7. The magenta polymerized toner according to claim 2, wherein the polymerized toner comprises, based on 100 parts by weight of binder resin, 0.1 to 30 parts by weight of wax; 0.001 to 10 parts by weight of a cross-linking agent; 0.1 to 20 parts by weight of a charge control agent; 0.001 to 8 parts by weight of a molecular weight regulator; and 0.01 to 5 parts by weight of a reaction initiator.

8. The magenta polymerized toner according to claim 1, wherein the binder resin is copolymer of aromatic vinyl monomer; and at least one kind of monomer selected from the group consisting of acrylate-based monomer, methacrylate-based monomer and diene-based monomer.

9. The magenta polymerized toner according to claim 8, wherein the binder resin is copolymer obtained by further polymerizing acidic olefinic monomer or basic olefinic monomer.

10. The magenta polymerized toner according to claim 1, wherein the toner particles further comprises at least one additive selected from the group consisting of a lubricant, a coupling agent, and an external additive.

11. The magenta polymerized toner according to claim 1, wherein toner particles have a volume average particle diameter (dv) of 5~10 μm, and volume average particle diameter (dv)/number average particle diameter (dv) of 1.4 or less.

* * * * *